US005104463A

United States Patent [19]

Menke

[11] Patent Number: 5,104,463

[45] Date of Patent: Apr. 14, 1992

[54] BLACKENING PROCESS FOR STAINLESS STEELS

[75] Inventor: Joseph T. Menke, Davenport, Iowa

[73] Assignee: The United States of America as represented by the Secretary of the Army, Washington, D.C.

[21] Appl. No.: 594,538

[22] Filed: Oct. 9, 1990

[51] Int. Cl.[5] ..... C23C 22/24

[52] U.S. Cl. ..... 148/264; 148/242; 148/325

[58] Field of Search ..... 148/325, 242, 264

[56] References Cited

U.S. PATENT DOCUMENTS 3,915,759 10/1975 Smollett ..... 148/242

*Primary Examiner*—Sam Silverberg

*Attorney, Agent, or Firm*—Anthony T. Lane; Edward Goldberg; Edward F. Costigan

[57] ABSTRACT

A corrosion resistant stainless steel article is provided with a substantially uniform black oxide coating over the surface thereof, the article being formed from a steel alloy in martensitic structure which is treated in a boiling aqueous alkaline-chromate-oxidizing solution containing sodium hydroxide, sodium nitrate and sodium dichromate at a temperature in the range from about 230° F. to about 260° F. for 30 to 60 minutes.

6 Claims, No Drawings

BLACKENING PROCESS FOR STAINLESS STEELS

GOVERNMENTAL INTEREST

The invention described herein may be manufactured, used, and licensed by or for the Government for Government purposes without payment to me of any royalties thereon.

FIELD OF THE INVENTION

The present invention relates to metal finishes treatments for ferrous metals, and more particularly to an improved process for preparing corrosion resistant stainless steel with a black oxide coating.

BACKGROUND OF THE INVENTION

Black oxide coatings are a known class of finishes used with stainless steel alloys and other ferrous metals for enhancing appearance, corrosion resistance and the like. A variety of treatment techniques have been employed over the years for producing the desired black oxide coatings on the various types and forms of ferrous metals. It has been found, however, that the metal finishing treatments conventionally used with the various grades of stainless steel alloys to produce the desired black oxide coating are not suitable for grades of steel alloys that may be hardened by heat treatment such as 400 series martensitic stainless steel. For example, a fused salt oxidizing treatment for corrosion resistant steel alloys having a draw temperature greater than 900° F. employs a process temperature of 800° F. or higher, which temperatures unduly temper hardened 400 series steel resulting in the loss of physical properties and/or adversely affecting close dimensional tolerances of treated parts, and an alkaline oxidizing process suitable for providing a black coating on forms of 300 series corrosion resistance steel alloys, cast and malleable iron employs a treating bath with oxide/sulfide components which, when used for treatment of 400 series steel alloys, results in products having reduced corrosion resistance.

Additionally, an alkaline oxidizing process heretofore suggested for treating 400 series stainless steel alloys to achieve the desired black oxide coatings, employs an alkaline-chromate-oxidizing treatment bath operated at temperatures of 285° F. or higher, which was found to be unsuitable for producing the desired black oxide finish, or for that matter, a black finish of any type.

SUMMARY OF THE INVENTION

It is an object of the present invention to provide a process for treating various forms of ferrous metal to form a suitable black oxide finish on the surface thereof which could be carried out at low operating temperatures without any detrimental affects to the properties of the metal parts treated.

It is another object of the present invention to provide a process for treating various forms of heat treated, preferably heat hardened, ferrous metals which would readily produce a desired black oxide finish on the surface thereof suitable to enhance the appearance and corrosion resistance without any detrimental effects to the properties of the metals treated.

It is a further object of the present invention to provide an alkaline-chromate-oxidizing treatment process for various forms of heat treated, preferably essentially straight chromium content heat hardened grades of steel alloys such as 400 series stainless steel in martensitic structure, which is operated at temperatures that would readily produce a uniform black oxide coating on the surface thereof to enhance the appearance and corrosion resistance without any detrimental effects to the hardness or other physical properties of the metal or parts made therefrom.

It is a still further object of the present invention to provide a corrosion resistant stainless steel alloy having an essentially straight chromium content in excess of 10% in various forms with a substantially uniform black oxide coating on the surface thereof.

In accordance with the present invention there is provided a process for surface treating ferrous metals which comprises providing a heat treated, preferably essentially straight chromium content, grade of stainless steel alloy in various forms, and treating said steel alloy in an aqueous alkaline-chromate-oxidizing solution at a temperature of from about 230° F. to about 260° F. for the time necessary to form a black oxide coating on the surface thereof.

In another aspect of the present invention there is provided an essentially straight chromium content grade of corrosion resistant stainless steel of the martensitic type having a black oxide coating on the surface thereof.

Stainless steel alloys such as the 400 series, which have essentially straight chromium content in excess of 10% and can be hardened by heat treatment, may be treated in accordance with the process of the invention to readily provide a substantially uniform black oxide finish on the surface thereof. The black oxide finish will meet various known specifications for stainless steel having such a surface finish requirement. The operating temperature in accordance with the practice of the invention will not unduly temper the steel alloy during the finishing treatment process to detrimentally effect the hardness or other physical properties thereof and the finished parts will exhibit the desired appearance as well as enhanced corrosion resistance and the like.

Other objects and advantages of the present invention will become apparent from the detailed description and examples thereof which follow.

DETAILED DESCRIPTION OF THE INVENTION

The method according to the present invention is suitable to provide a substantially uniform black oxide surface finish on ferrous metals in various forms including various types of stainless steel alloys depending on the composition and heat treatment used. The method is particularly suitable for use in meeting the desired requirements for appearance and enhanced corrosion resistance of a group of alloy steels having an essentially straight chromium content in excess of 10% and small quantities of other known elements, such as the 400 series of stainless steel alloys. Such grades of stainless steel, in martensitic structure, can be hardened by heat treating and oil quenching or air cooling depending on the size of the part and the physical properties desired but are tempered at a temperature of less than 900° F. (482° C.). Thus, the operating temperatures of the finishing process must produce the desired black oxide coating without detrimental effects to the hardness or other physical properties of the treated alloy.

The treating bath used in the process of the invention is an aqueous alkaline-chromate oxidizing solution containing three essential components, sodium hydroxide, sodium nitrate and sodium dichromate. The sodium hydroxide and sodium nitrate components are used in a concentration sufficient to form a solution having a boiling point in the range from about 230° F. to about 260° F. and within which the amount of sodium dichromate required for the desired oxidizing effect will completely dissolve. In general, from about 4 to 6 pounds of a mixture of sodium hydroxide and sodium nitrate per gallon is suitable, the components being added as a mixture in a ratio by weight of sodium hydroxide/-sodium nitrate of about 65/35. A treating bath solution with a concentration greater than about 7 pounds of the sodium hydroxide/sodium nitrate components per gallon will generally effect a boiling point temperature operating temperature which is too high as well as limiting the solubility of the sodium dichromate component therein.

The amount of sodium dichromate used should be soluble in the aqueous alkaline solution in a concentration sufficient to obtain the desired oxidizing effect, generally from about 0.5 to about 3 pounds of sodium dichromate per gallon of solution being suitable. As indicated, the aqueous alkaline-chromate-oxidizing treating bath solution in accordance with the invention should have a boiling point in the range of from about 230° F. to about 260° F. to effect the desired black oxide coatings, it having been noted that operating temperatures in excess of 260° F. result in coatings which are, in general, brown in color with no portion thereof being black.

The time needed for treatment of ferrous metals in accordance with the invention to obtain a desired black oxide coating is not critical and, in general, can be relatively short, e.g., from about 30 to about 60 minutes. The metal specimens are immersed in the above described treating bath solution which is maintained at its boiling point for the entire period of treatment. It would be evident that the actual time of the treatment may vary depending upon the size of the part to be treated, the temperature of the part before immersion and related factors. Prior to the start of the treatment cycle, the surface of the part to be finished should be prepared by abrasive blasting with glass beads or other conventional methods that would avoid surface contamination. The condition of the surface to be coated would determine the need for any other prior treatment. After completion of the oxidizing treatment cycle, the treated parts are removed from the bath and rinsed in water or the like prior to any further processing.

The invention will now be further illustrated by the description of certain specific examples of its practice which are not intended to be limiting.

EXAMPLE 1

Six pounds of a mixture of sodium hydroxide and sodium nitrate in a ratio by weight of 66.5 sodium hydroxide to 33.5 sodium nitrate was added to an amount of water sufficient to prepare a gallon of solution in a stainless steel tank equipped with an agitator and heating means. To this mixture, 620 grams of sodium dichromate was added and a solution was formed. The solution was heated and brought to a boil at 250° F. Parts made from 410 grade stainless steel which had been blasted with glass beads were immersed in the boiling solution for 45 minutes, at the end of which time the temperature of the bath was approximately 255° F. The parts were then removed from the solution, rinsed in water and visually inspected. It was determined that each of the treated parts exhibited a uniform black color.

The temperature of the treatment bath described above was raised to 260° F. and a second set of parts made from 410 grade stainless steel which had been previously blasted with glass beads was immersed in the boiling solution. After immersion for 45 minutes, the solution temperature was approximately 270° F. The parts were then removed from the bath, rinsed in water and visually inspected. The treated parts were observed to exhibit a uniform brown color with no portion thereof being black in color.

EXAMPLE 2

Using the solution prepared as described in Example 1, sufficient water was added thereto until a boiling temperature of 240° F. was obtained. Three sets of stainless steel parts were prepared for use in this example by blasting with glass beads. One set of parts was prepared from 17-7 annealed stainless steel, a second set of parts was prepared from 17-7 precipitation hardened stainless in the RH 950 condition and a third set of parts was prepared from 410 stainless.

The above described parts were immersed in the treatment bath solution boiling at a temperature of approximately 240° F. After immersion for 45 minutes the temperature of the bath was approximately 250° F. The parts were then removed from the treatment bath, rinsed in water and visually inspected. It was observed that the parts made from the 410 series alloy and the 17-7 PH alloy in the RH950 condition exhibited a uniform black color while the 17-7 annealed alloy did not.

Having thus described the invention, it will be clear to those skilled in the art that variations in the actual processes described in the examples could be made without departing from the spirit of the invention. Therefore, the present invention is to be considered limited only by the appended claims.

What is claimed is:

1. A process for surface treating ferrous metals which comprises providing a heat treated grade of corrosion resistant stainless steel alloy in various forms and treating said steel alloy in a boiling aqueous alkaline-chromate-oxidizing treatment bath solution which consists essentially of a mixture of sodium hydroxide and sodium nitrate in a concentration sufficient to effect an aqueous solution having a boiling temperature of from about 230° F. to about 260° F. and a soluble amount of sodium dichromate in a concentration sufficient to effect oxidization for the time necessary to form a substantially uniform black oxide coating on the surface thereof.

2. The process according to claim 1, wherein said stainless steel alloy is a steel alloy in martensitic structure having an essentially straight chromium content in excess of 10%.

3. The process according to claim 1, wherein said stainless steel alloy is in the precipitation hardened condition having chromium and nickel contents.

4. The process according to claim 1, wherein said sodium hydroxide and sodium nitrate are in mixed in a weight ratio of about 66.5 sodium hydroxide to a out 33.5 sodium nitrate and said mixture is present in a concentration of from about 4 to 6 pounds per gallon of solution.

5. The process according to claim 4, wherein said sodium dichromate is present in a concentration of from about 0.5 to 3 pounds per gallon of solution.

6. A process for treating a steel alloy in various forms having an essentially straight chromium content in excess of 10% to form a black oxide coating on the surface thereof which comprises:

providing an article formed from a corrosion resistant stainless steel alloy in martensitic structure;

immersing said steel alloy article in a boiling aqueous solution consisting essentially of a mixture of sodium hydroxide and sodium nitrate in a weight ratio of about 66.5/33.5 in a concentration sufficient to effect an aqueous solution with a boiling point range of from about 230° F. to about 260° F. and sodium dichromate in an amount sufficient to effect the oxidation of said steel alloy, said steel alloy article being immersed in said boiling aqueous solution for the time necessary to effect a substantially uniform black oxide coating over a surface thereof; and recovering said stainless steel article from the boiling aqueous treatment solution and rinsing the same with water.

* * * * *